US005826404A

United States Patent [19]

Fuss et al.

[11] Patent Number: 5,826,404

[45] Date of Patent: Oct. 27, 1998

[54] SYSTEM AND METHOD FOR USE OF LOOSE FILL PACKING MATERIALS

[76] Inventors: Gunter G. Fuss, 932 Peninsula Ave. No. 408, San Mateo, Calif. 94401; Vladimir Yampolsky, 3330 Brittan Ave. #5, San Carlos, Calif. 94070

[21] Appl. No.: 673,296

[22] Filed: Jun. 28, 1996

Related U.S. Application Data

[63] Continuation-in-part of Ser. No. 101,499, Aug. 2, 1993, Pat. No. 5,788,078.

[51] Int. Cl.[6] ..... B65B 9/15; B65B 23/00

[52] U.S. Cl. ..... 53/459; 53/472; 53/567; 53/576; 53/577

[58] Field of Search ..... 53/459, 472, 469, 53/567, 576, 577

[56] References Cited

U.S. PATENT DOCUMENTS

| | | | |
|---|---|---|---|
| 255,661 | 7/1882 | Atkins . | |
| 2,472,754 | 6/1949 | Mead . | |
| 2,656,658 | 10/1953 | Grady | 53/576 |
| 2,778,173 | 1/1957 | Taunton . | |
| 3,188,264 | 6/1965 | Holden . | |
| 3,281,089 | 10/1966 | Krueger et al. . | |
| 3,307,318 | 3/1967 | Bauman . | |
| 3,389,195 | 6/1968 | Gianakos et al. . | |
| 3,412,521 | 11/1968 | Bauman . | |
| 3,503,177 | 3/1970 | Kropscott et al. . | |
| 3,515,267 | 6/1970 | La Rocca et al. . | |
| 3,968,620 | 7/1976 | Keltner . | |
| 4,193,499 | 3/1980 | Lookholder . | |
| 4,446,677 | 5/1984 | Kokido | 53/576 X |
| 4,590,748 | 5/1986 | Harrison et al. | 53/576 |
| 4,620,633 | 11/1986 | Lookholder . | |
| 4,640,080 | 2/1987 | Wright | 53/472 X |
| 4,790,124 | 12/1988 | Kaji | 53/576 X |
| 4,800,708 | 1/1989 | Sperry | 53/472 X |
| 4,993,210 | 2/1991 | Kollross | 53/567 X |
| 5,009,318 | 4/1991 | Lepinoy . | |
| 5,079,787 | 1/1992 | Pollmann . | |
| 5,129,519 | 7/1992 | David et al. . | |
| 5,151,312 | 9/1992 | Boeri . | |
| 5,186,990 | 2/1993 | Starcevich . | |
| 5,316,149 | 5/1994 | Tate | 53/472 X |
| 5,408,791 | 4/1995 | Marie | 53/567 X |

FOREIGN PATENT DOCUMENTS

| | | |
|---|---|---|
| 456147A1 | 11/1991 | European Pat. Off. . |
| 1196228 | 5/1961 | France . |
| 93147317 U | 2/1994 | Germany . |
| 1564397 | 4/1980 | United Kingdom . |
| WO9406687 | 3/1994 | WIPO . |

OTHER PUBLICATIONS

Newtec USA, Inc., Butler, Pennsylvania, product sheet relating to produce packaging equipment which makes bags from tubular polyethylene or plstic net.

Newtec USA, Inc., Butler, Pennsylvania, product sheet relating to an automatic sleeving machine which gathers the tubular matrials on a mandrel.

*Primary Examiner*—Horace M. Culver

*Attorney, Agent, or Firm*—Flehr Hohback Test Albritton & Herbert LLP

[57] ABSTRACT

System and method for packing loose fill materials in bags to form cushions for use in protecting articles in shipping cartons. The bags are produced from a length of flexible plastic tubing which is folded and gathered to form a coil which is disposed about the outlet of a loose fill dispenser. A section of the tubing is pulled from the coil, and its lower end is closed to form a bag which is then filled with loose fill material dispensed through the outlet. Another section of tubing is then pulled from the coil, and the tubing is drawn together to close the upper end of the first section and the lower end of the second section. The closed ends are secured with tape, and the tubing is severed to separate the first section from the second. The cushions thus formed are placed in the shipping cartons with the articles, and in some embodiments are compressed and reexpanded in conformance with the contour of the articles.

11 Claims, 3 Drawing Sheets

SYSTEM AND METHOD FOR USE OF LOOSE FILL PACKING MATERIALS

This is a continuation-in-part of application Ser. No. 08/101,499, filed Aug. 2, 1993, now U.S. Pat. No. 5,788, 078.

This invention pertains generally to loose fill packing materials and, more particularly, to a system and method for packaging loose fill packing material in bags for use as cushions in shipping cartons.

Loose fill packing materials are widely used in the protective packing of articles for shipment. They are commonly poured into a carton so as to surround and embrace the articles and thereby cushion them during shipment.

Loose fill materials are fabricated of a variety of materials such as foamed plastics and, more recently, starch and other biodegradable materials.

One problem with loose fill materials is that they tend to spill both during packaging and also when the cartons are opened and the articles packed in them are removed. Being light in weight, the materials also have a tendency to fly about, and some of them exhibit a static cling which makes them particularly difficult to deal with.

It is in general an object of the invention to provide a new and improved system and method for utilizing loose fill packing materials.

Another object of the invention is to provide a system and method of the above character which eliminates the messiness, spillage and static cling which occur when articles are packed in loose fill materials.

These and other objects are achieved in accordance with the invention by packing loose fill materials in bags to form cushions for use in protecting articles in shipping cartons. The bags are produced from a length of flexible plastic tubing which is folded and gathered to form a coil which is disposed about the outlet of a loose fill dispenser. A section of the tubing is pulled from the coil, and its lower end is closed to form a bag which is then filled with loose fill material dispensed through the outlet. Another section of tubing is then pulled from the coil, and the tubing is drawn together to close the upper end of the first section and the lower end of the second section. The closed ends are secured with tape, and the tubing is severed to separate the first section from the second. The cushions thus formed are placed in the shipping cartons with the articles, and in some embodiments are compressed and reexpanded in conformance with the contour of the articles.

Figure 1:
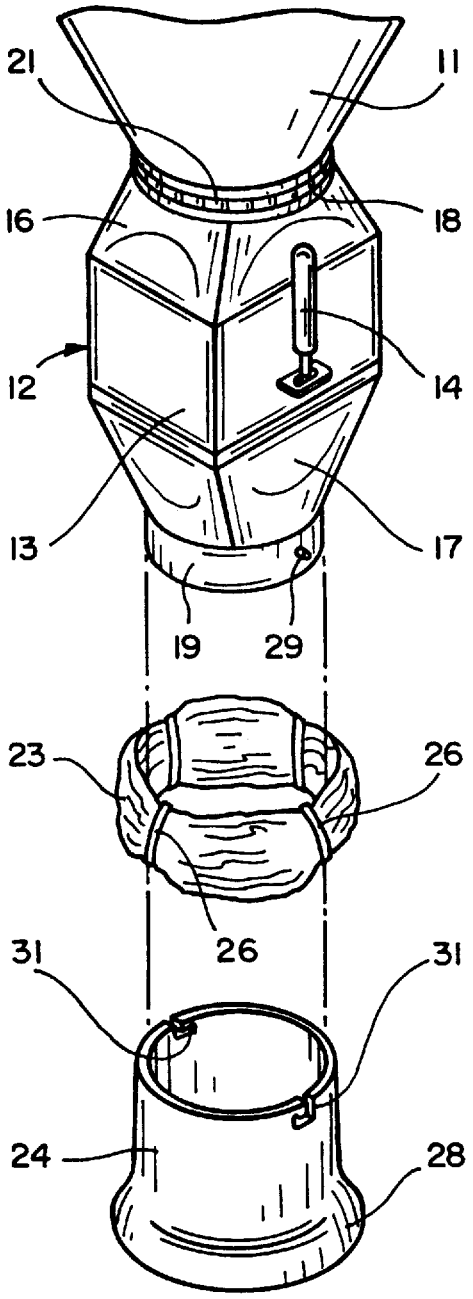
FIG. 1 is a fragmentary, partly exploded isometric view of one embodiment of a system according to the invention for bagging loose fill packing material.

As illustrated in FIG. 1, the system includes a hopper 11 for holding a supply of loose fill packing material, with a valve 12 at the lower end of the hopper for dispensing the material from the hopper. The valve can, for example, be of the type disclosed in U.S. Pat. No. 4,844,291, the disclosure of which is incorporated herein by reference. It has a generally rectangular body 13 with a pair of hinged flaps (not shown) connected to an operator 14 for controlling the flow of material through the valve. The valve has transition pieces 16, 17 on its inlet and outlet sides, with circular collars 18, 19 at the outer ends thereof.

Hopper 11 comprises a tapered bag fabricated of a flexible plastic material such as polyethylene which is suspended from the ceiling or other suitable support. The upper end of the hopper bag is open, and the lower end is secured to the circular collar on the upper, or inlet, side of the valve by a band clamp 21.

On the outlet side of the valve, a length of flexible plastic tubing 23 is stored on a coil holder 24 mounted on collar 19 for use in the formation of bags for holding loose fill material dispensed through the valve. The tubing is folded and gathered in an axial direction to form a coil which is held together by ties 26 until it is mounted on the coil holder. The tubing can be fabricated of any suitable material such as polyethylene, and can be of any desired weight. A polyethylene tubing having a wall thickness of 0.5 mil has been found to provide good strength and flexibility for the bags, and with a 0.5 mil material, a coil can contain several hundred feet of tubing. Other suitable materials include high density polyethylene, low density polyethylene, netting, and cellulose (paper) products.

The tubing is provided with vent holes 27 which serve to prevent air from being trapped within the tubing as the side walls are drawn together to form the cushions. The holes can be of any suitable size and spacing, and in one presently preferred embodiment, they are on the order of ⅜ inch in diameter and spaced on centers about 4–5 inches apart.

The lower end 28 of the coil holder is enlarged to retain the coil on the coil holder. The tubing is withdrawn from the coil holder by pulling it down over the enlarged end, with the outer diameter of the enlarged end being slightly larger than the unstretched tubing so that the tubing will remain in place unless it is pulled. In the embodiment illustrated, the enlarged end is shown as a flare. However, it can be formed in any other suitable manner such as by slotting the end portion of the cylindrical side wall and bending the tabs thus formed between the slots in an outward direction or by attaching a plurality of outwardly projecting tabs to the side wall.

The coil holder is removably mounted on outlet collar 19 by means of a bayonet mount comprising a pair of pins 29 which extend radially from the collar and are received in J-shaped slots 31 in the upper end of the cylindrical side wall of the coil holder.

Figure 4:
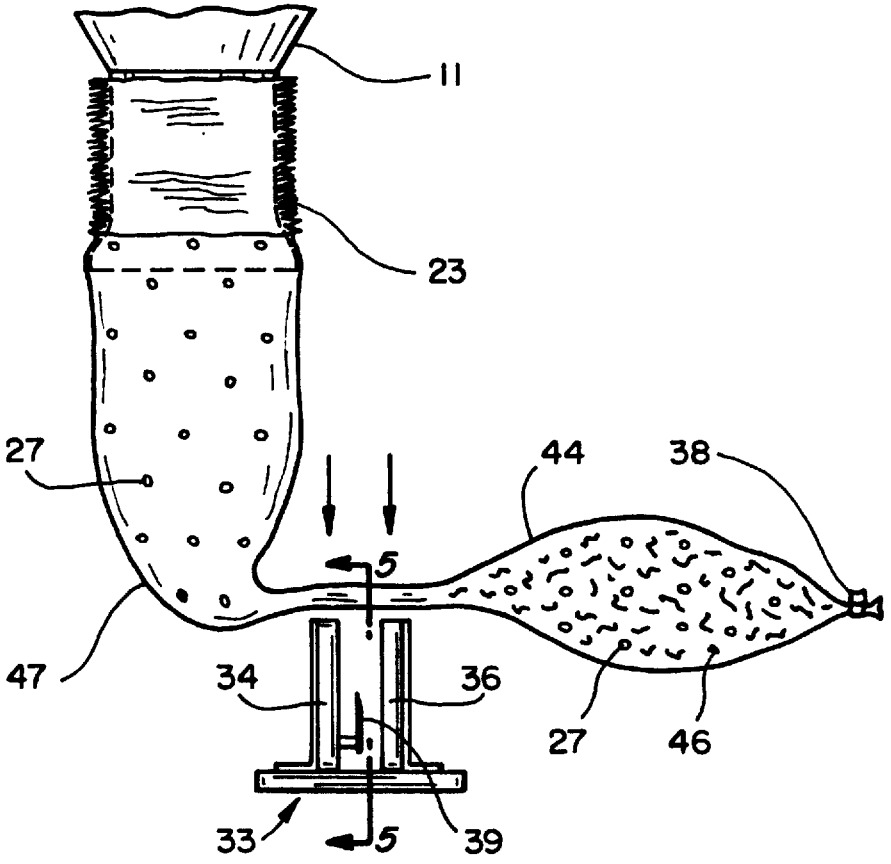
FIG. 4 is a view similar to FIG. 3, illustrating the closing and cutting of successive bags of loose fill material.
Figure 5:
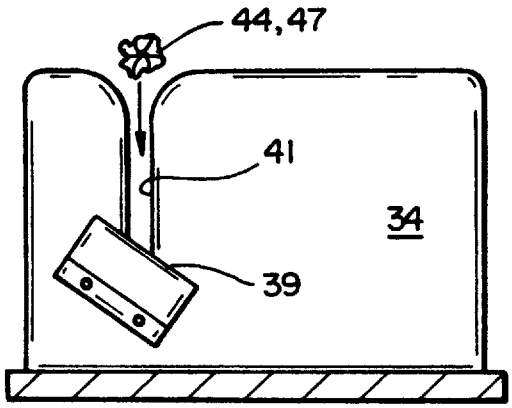
FIG. 5 is a cross-sectional view taken along line 5—5 in FIG. 4.

As illustrated in FIGS. 4–5, the system also includes a tool 33 for cutting the tubing into bag-length sections and the closing bags thus formed. This tool includes a pair of tape dispensers 34, 36 which apply bands of tape 37, 38 to the tubing after it has been drawn together, and a cutting blade or knife 39 which cuts the two sections of tubing apart between the bands of tape. Suitable tape dispensers are available commercially, and one particularly suitable unit is the Excell® EG Cut Bag Sealer, Model No. 605K.

Each of the tape dispensers has a vertically extending guide slot 41 through which the gathered walls of the tubing are drawn to trigger the application of the tape. The blade is positioned toward the lower ends of the guide slots and inclined at an angle of about 45° to the slots for slicing the tubing material immediately after it passes the point where the tape is applied.

The taping and cutting tool is positioned below and to one side of the outlet of the dispenser, within reach of the lower end of a bag which is still hanging from the coil holder. The tool can be mounted on a stand or other suitable support.

If desired, the closed ends of the tubing sections or bags can be secured with means other than tape strips. Other suitable means include metal clips, heat sealing, wire ties, plastic ties, string, and the like.

The loose fill material can be any material which is suitable for use in the cushions. Suitable materials include, but are not limited to, polystyrene, starch-based materials, paper and popcorn. It is also possible to use brittle and flaky materials which ordinarily are not suitable for use as packing materials. It is also possible to use combinations of different materials, and since they are enclosed within the bags, they will not be unsightly.

Operation and use of the system, and therein the method of the invention, are as follows. Loose fill material is introduced into the hopper from above by suitable means such as a pneumatic conveyor (not shown) or by lowering the hopper bag and pouring the material into it. Coil holder 24 is removed from the dispenser, and a coil of tubing 23 is placed on it. The coil holder is reattached to outlet collar 19, and the ties 26 which hold the coil together are removed.

Figure 3:
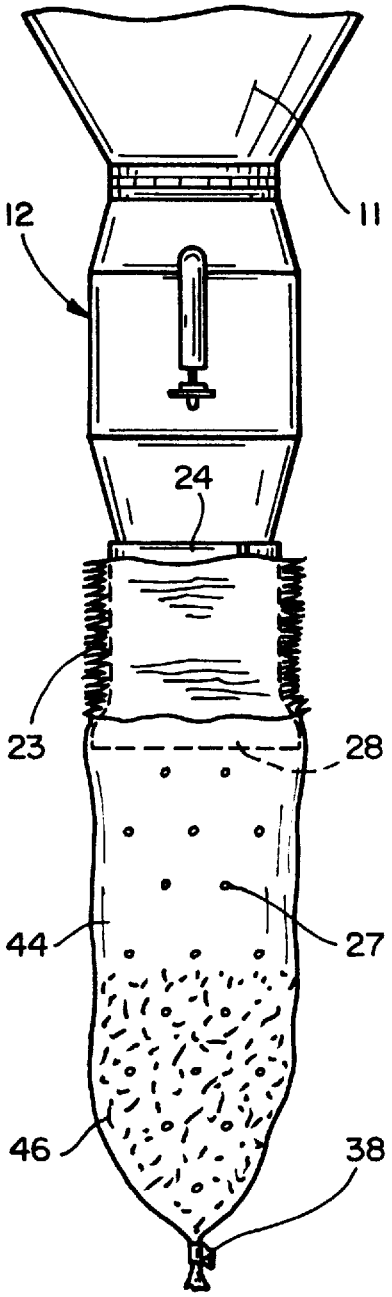
FIG. 3 is a front elevational view of the embodiment of FIG. 1, illustrating the formation and filling of a bag with loose fill material.
Figure 2:
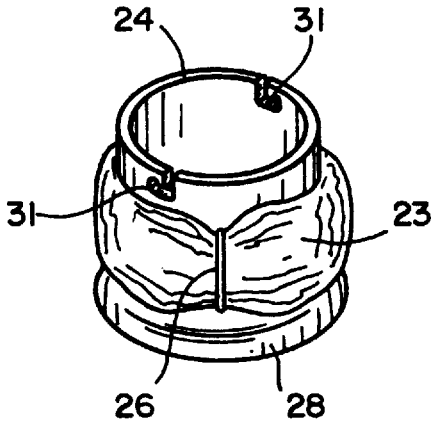
FIG. 2 is an isometric view of the coil holder with tubing from which bags are formed in the embodiment of FIG. 1.

A first section of tubing 44 is withdrawn from the coil by pulling it down over the enlarged lower end 28 of the coil holder, and the lower end of that section is drawn together and taped to form a bag which hangs from the dispenser, as illustrated in FIG. 3. The valve is then opened to discharge a predetermined amount of the loose fill material 46 into the bag.

After the bag has been filled, a second section of tubing 47 is withdrawn from the coil, and the portion of the tubing between the two sections is drawn together and passed through taping and cutting tool 33. As the material is pressed into the tool and passes in a downward direction through the guide slots 41, bands of tape 37, 38 are applied simultaneously to the upper end of section 44 and to the lower end of section 47 to secure those ends in the closed position. The downward motion of the tubing then brings it into contact with blade 39 which severs the tubing between the two bands of tape, thereby separating the filled bag or cushion 49 formed by section 44 from section 47.

This process is repeated to form additional bags or cushions from successive sections of the tubing.

Figure 6:
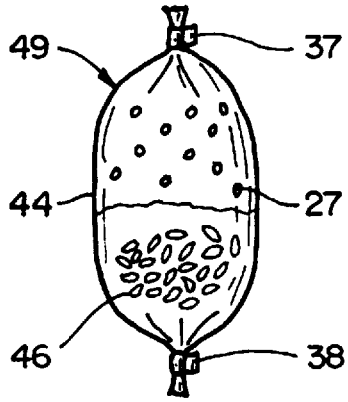
FIG. 6 is an isometric view of a bag filled with loose fill packing material in accordance with the invention.

A finished cushion is illustrated in FIG. 6. As discussed more fully hereinafter, it is used by placing it and other cushions like it about an article in a carton. With the loose fill material enclosed in the cushion, there is no spillage of material during the packaging process.

When the carton is opened and the articles inside it are removed, there is no spillage or other mess with loose fill materials, and there is no need to dig for the articles in the material. The cushions are simply removed from the carton as needed to provide access to the articles. The cushions remain in tact, with the loose fill material fully contained within them, and they can be recycled, reused, or disposed of, as desired.

Figure 7:
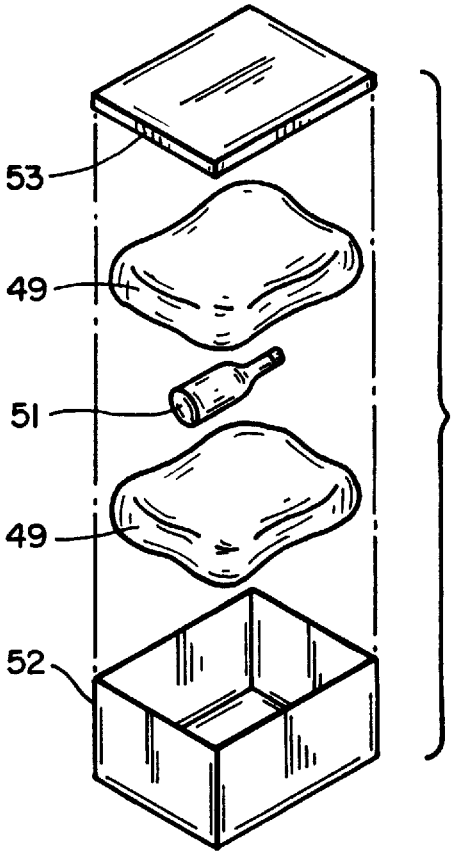
FIG. 7 is an exploded isometric view of an article packed with cushions in accordance with the invention.

In some applications it may be desirable to compress the cushions before they are placed in the carton, then allow them to expand about the article(s) to be protected. Such an application is illustrated in FIG. 7 in conjunction with the packaging of an article 51 in a carton or container 52 which has a removable lid or top 53. The article is illustrated as being in the form of a bottle, but it can be anything that needs to be protectively packaged. The container is illustrated as being a cardboard box, but it can be any container which is suitable for packaging or shipping the article. The lid can be secured to the container by any suitable means such as taping or stapling.

In this embodiment, the tubing from which the bags are formed is unvented (i.e., without vent holes 27), and after the bags are closed, air and/or other gases or fluids are withdrawn from them to reduce the pressure within them to a level below that of the surrounding environment, e.g. below atmospheric pressure. That is conveniently done by piercing each bag with a lance or needle connected to a vacuum pump. The difference in the air pressures inside and outside the bags compresses the fill material until the resilient force of the material counterbalances the compressive force applied by the pressure differential. The interiors of the cushions are thereafter repressurized to reexpand the fill material to conform to contours of the article and the interior walls of the container. The cushions can be reexpanded and used immediately after compression, or they can be sealed for storage and/or shipment in the compressed state.

If desired, recyclable, biodegradable, and/or water-soluble materials can be used either for the tubing or for the fill material, or both.

For the tubing, suitable recyclable materials include Saran, ethylene vinyl acetate (EVA), polyethylene film, paper, and the like. Suitable water-soluble materials include polyvinyl alcohol (PVOH) based materials, and hydrocarbon based alloys, such as the Enviroplastic-H based on polyoxyethylene, for example. Suitable biodegradable materials include water-soluble polyvinyl alcohol (PVOH) based films; poly-caprolactone-alphatic ester based materials; polyhydroxybutyrate-valerate (PHBV) copolymers; polyoxyethylene based materials; polyester based compostable material; starch based biopolymer materials; and other starch based materials such as those that include a catalyst to enhance photo and oxidative degradation.

For the fill material, suitable recyclable materials include extruded polystyrene (EPS) beads and other materials which are neither biodegradable nor water soluble. Suitable biodegradable materials include starch graft copolymer materials, starch biopolymer materials, wood chips and shavings, plant fibers, twigs, seeds, popcorn, and the like. Suitable water soluble materials include starch based materials and other water soluble materials. Where vented tubing is used for the bags, the particles of fill material should, of course, be larger than the vent openings to prevent spillage from the bags.

The invention has a number of important features and advantages. It enables packing cushions to be manufactured at the point of use quickly and economically without the spillage and mess normally associated with loose fill materials. It also eliminates the problems of messiness and spillage at the receiving end when the cartons are opened and the articles packed therein are removed. Being contained in the cushions, the loose fill material will not tend to cling to the articles packed in it or to the hands and arms of a person removing the articles from it. The cushions also prevent the packaged goods from contact with materials such as starch which tend to absorb water and become soggy during humid conditions. The cushions can be molded to the shape of the articles to be protected, and tend to provide better protection than a loose body of material. If desired, advertising and/or other messages can be printed on the bags.

It is apparent from the foregoing that a new and improved system and method for bagging loose fill packing materials has been provided. While only certain presently preferred embodiments have been described in detail, as will be apparent to those familiar with the art, certain changes and modifications can be made without departing from the scope of the invention as defined by the following claims.

We claim:

1. A system for packaging loose fill packing material in bags for use as cushions in shipping cartons, comprising:

a dispenser having an outlet through which loose fill packing material is discharged;

an elongated length of flexible plastic tubing folded and gathered axially about the outlet to form a coil from which successive sections of the tubing can be pulled and closed at their lower ends to form bags for receiving loose fill material discharged through the outlet;

means for actuating the dispenser to fill a section of the tubing which has been pulled from the coil and closed at its lower end;

means for simultaneously closing the upper end of the filled section and the lower end of the next section pulled from the coil; and means for severing the filled section from the next successive section after the ends of the two sections have been closed.

2. The system of claim 1 wherein the dispenser includes a coil holder on which the coil of tubing is mounted, the coil holder having an enlarged lower end over which the tubing is pulled.

3. The system of claim 1 wherein the means for closing the ends of the tubing sections includes means for drawing the tubing together and applying two axially spaced fasteners to the tubing to hold it together.

4. The system of claim 3 wherein the means for severing the two sections includes means for cutting the tubing between the two fasteners.

5. The system of claim 3 wherein the fasteners are bands of tape.

6. A method of packaging loose fill packing material in bags for use as cushions in shipping cartons, comprising the steps of:

axially folding and gathering an elongated length of flexible plastic tubing to form a coil from which successive sections can be pulled;

positioning the coil about the outlet of a packing material dispenser;

pulling a first section of the tubing from the coil in an axial direction;

closing the lower end of the first section to form a bag;

dispensing packing material through the outlet and into the first section;

pulling a second section of the tubing from the coil;

drawing the tubing together between the first and second sections to close the upper end of the first section and the lower end of the second section;

simultaneously securing the ends of the two sections in their closed condition; and severing the tubing between the two sections after the closed ends are secured.

7. The method of claim 6 wherein the closed ends of the two sections are secured together simultaneously.

8. The method of claim 6 wherein the ends of the tubing are secured in their closed condition by applying spaced apart bands of tape to the end portions of the two sections.

9. The method of claim 6 wherein the tubing is severed immediately after the closed ends of the two sections are secured together.

10. A method of packing an article in a shipping carton with loose fill packing material, comprising the steps of:

axially folding and gathering an elongated length of flexible plastic tubing to form a coil from which successive sections can be pulled;

positioning the coil about the outlet of a packing material dispenser;

pulling a first section of the tubing from the coil in an axial direction;

closing the lower end of the first section to form a bag;

dispensing packing material through the outlet and into the first section to form a cushion;

pulling a second section of the tubing from the coil;

drawing the tubing together between the first and second sections to simultaneously close the upper end of the first section and the lower end of the second section;

simultaneously securing the closed ends of the sections together;

severing the tubing between the two sections to separate the cushion formed by the first section from the second section;

placing the article in the carton; and placing the cushion in the carton with the article to protect the article.

11. The method of claim 10 including the steps of reducing air pressure within the cushion to compress the cushion before placing it in the carton, and repressurizing the cushion after it is placed in the carton so that the cushion reexpands and molds itself about the article.

* * * * *